US005661275A

United States Patent [19]

Marchini et al.

[11] Patent Number: 5,661,275

[45] Date of Patent: Aug. 26, 1997

[54] SELF ADJUSTING SWITCH MECHANISM

[75] Inventors: Michael G. Marchini, Freeport; Duane C. Shaw, Warren, both of Ill.

[73] Assignee: Honeywell Inc., Minneapolis, Minn.

[21] Appl. No.: 587,165

[22] Filed: Jan. 16, 1996

[51] Int. Cl.[6] ..... H01H 9/20

[52] U.S. Cl. ..... 200/50.01

[58] Field of Search ..... 200/50.01, 50.11, 200/50.18, 50.28, 50.31

[56] References Cited

U.S. PATENT DOCUMENTS

| | | | |
|---|---|---|---|
| 4,688,145 | 8/1987 | Mikulecky | 200/50.27 |
| 4,798,923 | 1/1989 | Barwick et al. | 200/50.01 |
| 4,980,800 | 12/1990 | Furuta | 200/50.01 |
| 5,504,285 | 4/1996 | Castonguay et al. | 200/50.01 |
| 5,557,498 | 9/1996 | Dosmo et al. | 200/50.01 |

*Primary Examiner*—Matthew V. Nguyen

*Attorney, Agent, or Firm*—William D. Lanyi; John G. Shudy, Jr.

[57] ABSTRACT

A self adjusting switch mechanism is provided which permits the specific location of a switch to be determined during an initial operation that moves a mounting plate relative to a bracket portion of the mechanism. This initial movement sets the switch in its proper position and prevents further movement. Subsequent operations of the device depress a plunger of the switch but do not change the relative position of the switch housing relative to a stationary structure, such as the housing of an appliance. Certain embodiments of the mechanism further incorporate a locking mechanism that can be manually set to prevent any further movement of the mounting plate relative to the bracket portion in response to jarring forces, such as when the door of an appliance is slammed shut.

20 Claims, 9 Drawing Sheets

SELF ADJUSTING SWITCH MECHANISM

BACKGROUND OF THE INVENTION

1. Field of the Invention

The present invention is generally related to a self adjusting switch mechanism and, more specifically, to a switch mechanism intended for use with an appliance and provided for the purpose of adjusting the position of a switch so that complicated assembly and calibration procedures can be avoided.

2. Description of the Prior Art

Many different types of switches have been used by those skilled in the art. Certain switches are used in association with appliances, such as washing machines and dishwashers. One particular application for a switch in an appliance is to detect the closure of a door so that operation of the appliance can be terminated when the door is opened. For example, when the door of a washing machine is opened, the operation of the washing machine is stopped for safety purposes.

When a switch is used to detect the open or closed status of an appliance door, the switch is typically actuated by the movement of an actuating bar or bracket attached to the door. When the door is opened, the bar or bracket moves away from contact with the switch actuator and an electrical circuit is opened for the purpose of stopping the operation of the device. When a switch of this type is attached to a stationary portion of the appliance, it must be positioned with sufficient accuracy to cause the switch to be actuated in response to movement of the door. Since the appliance door, the actuating bar or rod and the housing are all manufactured within certain tolerance ranges, the accumulation of tolerances occasionally causes the position of the actuator bar or rod to differ from its intended position relative to the switch actuator or plunger. When this occurs, the realized travel exceeds or falls short of the expected travel of the rod or actuator bar which is necessary to actuate the switch. When this occurs, physical movement of the switch is necessary and the position of the switch must be calibrated to assure that movement of the appliance door will cause the switch plunger to move from a deactuated position to an actuated position. In addition, the switch must be properly positioned to prevent damage from occurring to the switch when the door is closed.

It would therefore be beneficial if a self adjusting switch mechanism could be provided in order to automatically position the switch relative to the stationary and movable portions of the appliance so that movement of the door will depress the switch actuator, or plunger, by the appropriate amount without causing damage to the switch and without providing insufficient movement of the switch plunger.

SUMMARY OF THE INVENTION

The present invention provides a self adjusting switch mechanism that comprises a bracket portion that is flexibly attachable to a stationary object. In a most preferred embodiment of the present invention, the bracket portion is attachable to the stationary housing structure of an appliance. The present invention further comprises a mounting plate that is rotatably attached to the bracket portion of the mechanism. The mounting plate is shaped to receive a switch in a fixed relationship with the mounting plate. In a preferred embodiment of the present invention, the mounting plate is shaped to receive the switch and hold the switch in a rigid position relative to the mounting plate. Guide pins and holding fingers can be used to retain the switch in position relative to the mounting plate. The mounting plate is rotatable relative to the bracket portion in response to a force that is greater than a preselected magnitude and is exerted against an actuator of the switch. The actuator, in many application of the present invention, is a plunger that is movable into and out of the housing of the switch. A preferred embodiment of the present invention further comprises a means for retaining the mounting plate in a fixed position relative to the bracket portion when the external force is less than the preselected magnitude. The retaining means is configured in a way to permit the mounting plate to move relative to the bracket portion when the force exceeds the preselected magnitude. In other words, the retaining means holds the mounting plate in a fixed position relative to the bracket portion unless a sufficiently large magnitude of force is exerted against the switch. When this sufficient magnitude of force is exerted against the switch, the switch and its attached mounting plate can rotate relative to the bracket portion.

In a typical application of the present invention, the force is exerted against the bracket portion by a movable member that is attached to the stationary object and the bracket portion moves relative to the appliance housing to push the switch plunger against a stationary object. The movable member can be the door of an appliance and the stationary object can be the housing of the appliance.

The mechanism of the present invention does not require the presence of the switch attached to the mounting plate but, when the mechanism of the present invention is assembled in association with the appliance, a switch is snapped into position on the mounting plate. In other words, the present invention comprises the bracket portion, the mounting plate and the retaining means, but need not include the switch itself. A switch is attachable to the present invention when the present invention is mounted in an appliance or other similar apparatus.

The actuator or plunger of the switch is typically movable relative to its housing in response to the force when the force is less than the preselected magnitude described above. In other words, a force can be sufficient to depress the actuator of the switch relative to its housing without being sufficient to exceed the preselected magnitude required to cause rotation of the mounting plate relative to the bracket portion of the present invention. In fact, the basic operational characteristic of the present invention takes advantage of the minimal force necessary to actuate the switch which is less than the preselected magnitude necessary to cause relative movement between the mounting plate and the bracket portion of the present invention.

In a particularly preferred embodiment of the present invention, a retaining means comprises a plurality of teeth that are formed in the mounting plate and a protrusion extending from the bracket portion. The protrusion is disposable in contact with one or more interstitial spaces of the plurality of teeth to form a ratchet mechanism. When the force exceeds the preselected magnitude, the plurality of teeth can move relative to the protrusion as the teeth are forced in a direction past the protrusion and the protrusion rubs across the plurality of teeth. However, when the force is less than the preselected magnitude, the protrusion is maintained in position in a space between the two adjacent teeth and movement of the mounting plate relative to the bracket portion is inhibited. To facilitate this operation, the protrusion is formed as a part of an adjustment cantilever that is provided with sufficient flexibility to exert a force on the protrusion in a direction of the plurality of teeth. When the force exerted on the switch exceeds the preselected magnitude, it is sufficient to deflect the adjustment cantilever and move the plurality of teeth relative to the protrusion even though the protrusion is in contact with the plurality of teeth.

The present invention further comprises a means for locking the retaining means to prevent the mounting plate from moving relative to the bracket portion in response to the force being greater than the preselected magnitude described above. In other words, the locking means provides an additional force to exert against the adjustment cantilever and force the protrusion into a gap between two adjacent teeth of the plurality of teeth that is sufficient to resist the movement of the plurality of teeth relative to the protrusion even when the force on the switch exceeds the preselected magnitude. This locking means is provided to prevent additional movement after the appropriate self adjustment is accomplished by the present invention. The locking means can comprise a notch formed in an adjustment member, such as the adjustment cantilever, and a locking member that is formed as part of a locking cantilever component. The locking member is disposable into the notch in order to prevent the mounting plate from moving relative to the bracket portion when the force exceeds the preselected magnitude.

The stationary object can be a housing of an appliance and the force can be exerted by a door of the appliance.

BRIEF DESCRIPTION OF THE DRAWINGS

The present invention will be more fully and completely understood from a reading of the Description of the Preferred Embodiment in conjunction with the drawings, in which.

DESCRIPTION OF THE PREFERRED EMBODIMENT

Figure 1:
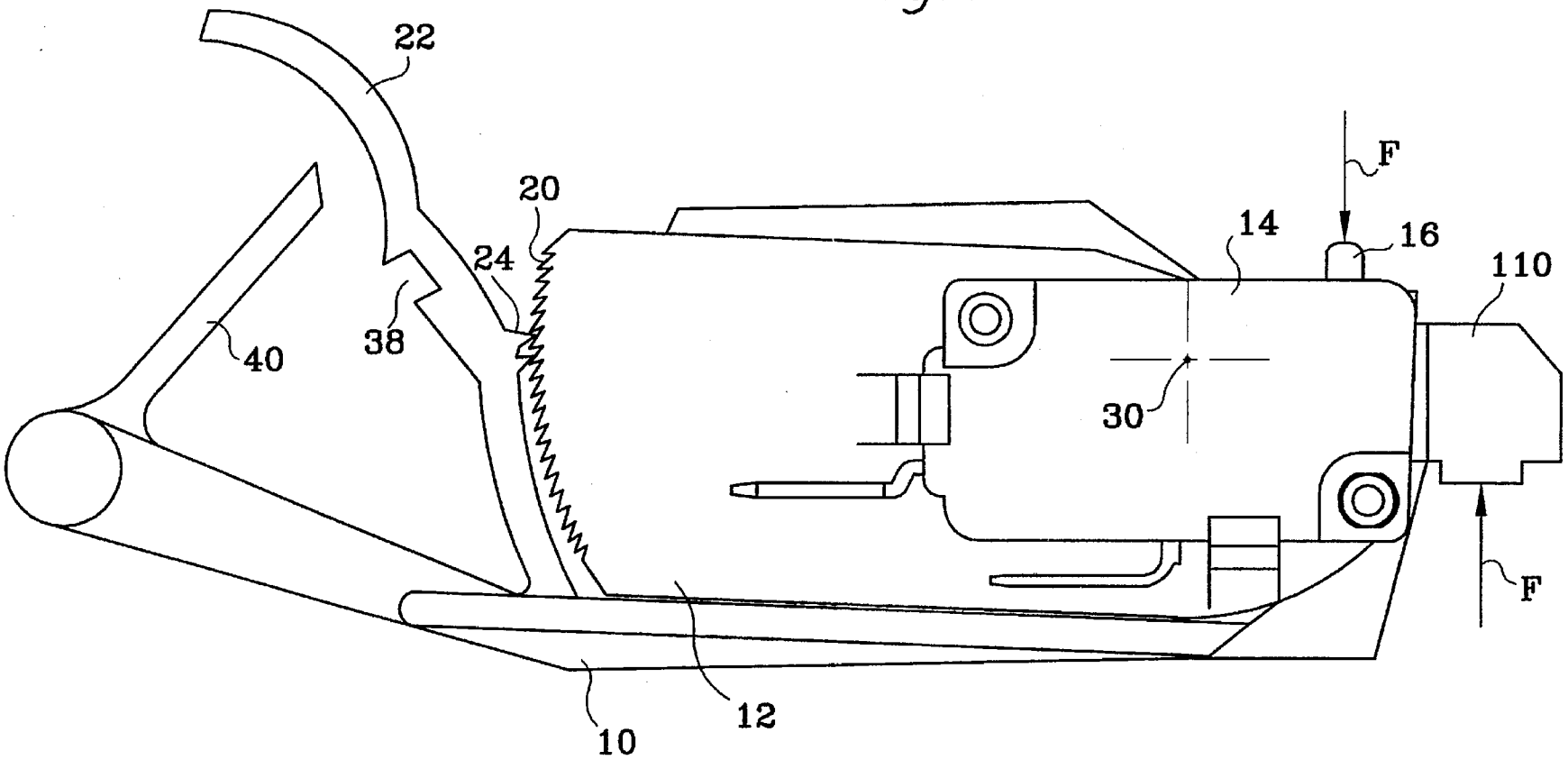
FIG. 1 is a side view of the present invention in conjunction with a switch.

Throughout the Description of the Preferred Embodiment, like components will be identified by like reference numerals. In FIG. 1, the bracket portion 10 is shown associated with a mounting plate 12. A switch 14 is rigidly attached to the mounting plate 12. The switch 14 is provided with a plunger 16 that electrically actuates the switch in response to depression of the plunger 16 relative to the housing of the switch 14. The mounting plate 12 is provided with a plurality of teeth 20 and the bracket portion 10 is provided with an adjustment cantilever 22 that is formed to have a protrusion 24 extending from it. The protrusion 24 is in contact with one or more of the plurality of teeth 20.

With continued reference to FIG. 1, the mounting plate 12 is rotatably attached to the bracket portion 10 and can rotate about a point 30 in response to a force F exerted against the switch and the bracket portion as shown. Arrows F represent a force exerted by an actuating bar (not shown) and an opposing force on the plunger 16.

As is known to those skilled in the art, switches of the type shown in FIG. 1 typically operate in response to depression of the plunger 16 relative to the switch housing. The force required to depress the plunger 16 is relatively slight and is insufficient to cause the mounting plate 12 to rotate about point 30 relative to the bracket portion 10. However, when the plunger 16 is fully depressed into the housing of the switch and achieves its maximum travel into the housing, continued application of force F can exceed the preselected magnitude necessary to cause rotation of the mounting plate 12 relative to the bracket portion 10. When the force F exceeds this preselected magnitude, the mounting plate 12 rotates in a clockwise direction about point 30 and the plurality of teeth 20 move relative to the protrusion 24. Naturally, when the force F is removed, the mounting plate 12 will remain in its position relative to the bracket portion 10 because of the presence of the protrusion 24 in a space between two adjacent teeth of the plurality of teeth 20. Therefore, the mechanism shown in FIG. 1 is self adjusting. For example, if the mounting plate 12 is initially rotated counterclockwise relative to the bracket portion 10 in FIG. 1 prior to the exertion of the force F, the initial exertion of a force F will first cause the plunger 16 to be depressed relative to the housing of the switch 14. After the plunger is completely depressed, continued application of the force F will cause the mounting plate 12 to rotate in a clockwise direction about point 30 if force F is of a sufficient magnitude to overcome the resistance provided by the presence of the protrusion 24 in contact with the plurality of teeth 20. When force F exceeds this preselected magnitude, the mounting plate 12 will rotate in a clockwise direction in response to the continued application of the force. When the force is removed, the mounting plate 12 will remain in the position of its maximum travel in the clockwise direction. Subsequent actuations of the force F will actuate the plunger 16, but not cause further rotation of the mounting plate 12 relative to the bracket portion 10 if the actuation device that provides the force F does not exceed its initial maximum travel in the direction of the arrow F shown in FIG. 1. This operation of the present invention places the plunger 16 at the desirable location relative to the actuating member that provides the force F. Repeated operations of this procedure will depress plunger 16 into the housing of the switch 14, but will not cause additional rotation of the mounting plate 12 relative to the bracket portion 10.

It is recognized that certain unexpected forces can be exerted on the mechanism during operation of a related appliance. For example, the door of the appliance, on which the actuation bar is attached, can be closed with sufficient force to create an impact against the mechanism shown in FIG. 1. This impact, caused by slamming the door relative to the appliance housing, can jar the mechanism with sufficient force to cause the protrusion 24 to move relative to the plurality of teeth 20. This could create an undesirable situation that causes the calibration and adjustment of the mechanism to change.

Figure 2:
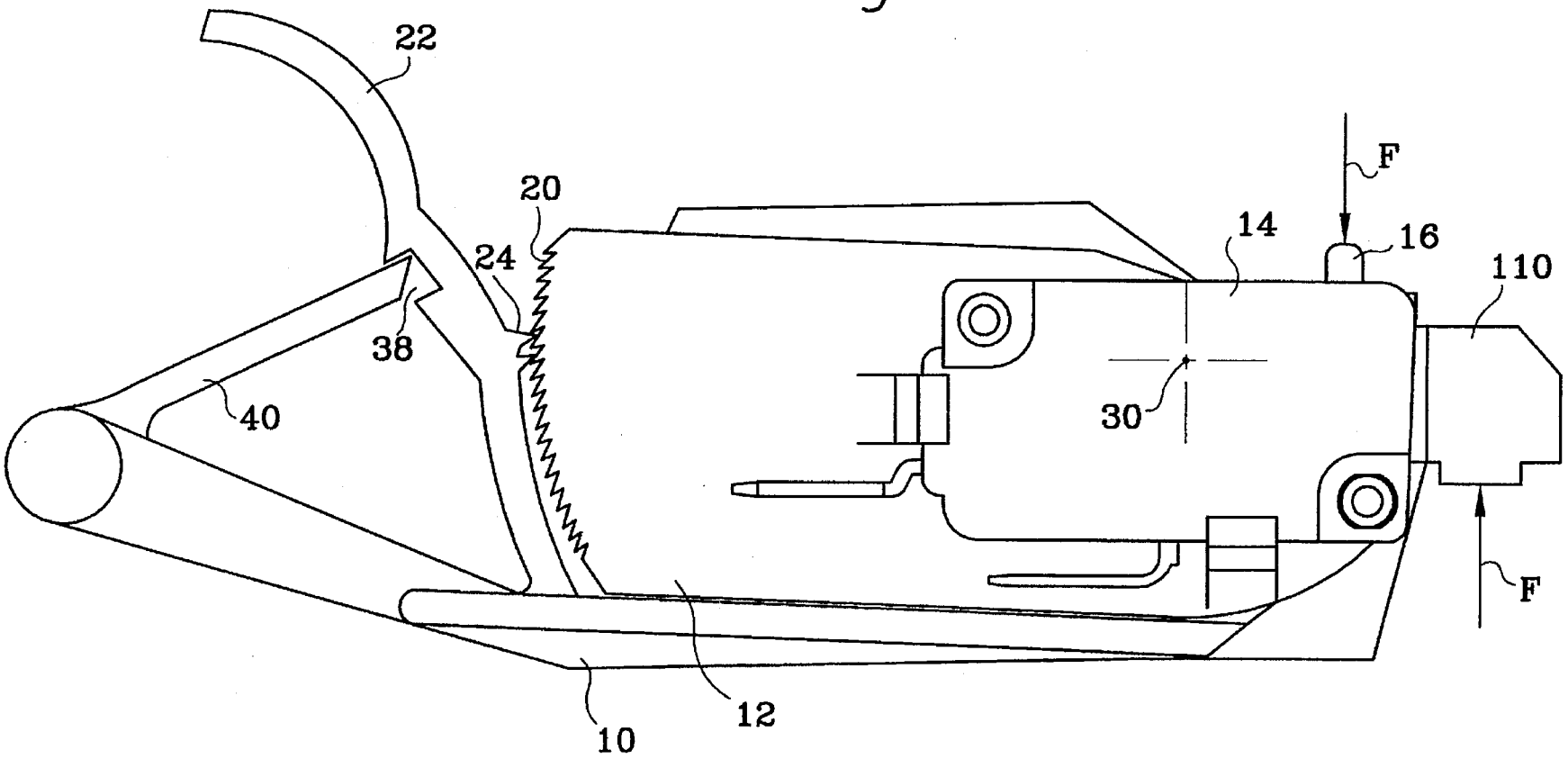
FIG. 2 is similar to FIG. 1, but with a locking mechanism actuated.

FIG. 2 shows an embodiment of the present invention in which a locking structure is provided. The locking structure prevents the misadjustment of the mechanism that could otherwise be caused by a jarring force such as that which might occur when the door is slammed. The means for locking the retaining mechanism in position comprises a notch 38 formed in the adjustment cantilever 22 and also comprises a locking member 40 that is formed as a locking cantilever that extends from the bracket portion 10. When the locking member 40 is disposed in the slot 38, it pushes against the adjustment cantilever 22 and forces the protrusion 24 against the plurality of teeth 20 with a greater force than is exerted merely by the resiliency of the adjustment cantilever 22. This additional force is sufficient to resist the movement of the mounting plate 12 relative to the bracket portion 10 in response to jarring movements such as those described above in conjunction with the slamming of the door. When the locking member 40 is disposed in the notch 38, the mounting plate 12 will not move relative to the bracket portion 10 even when the force F on the plunger 16 exceeds the preselected magnitude originally required to rotate the mounting plate 12 about the point 30.

Figure 3A:
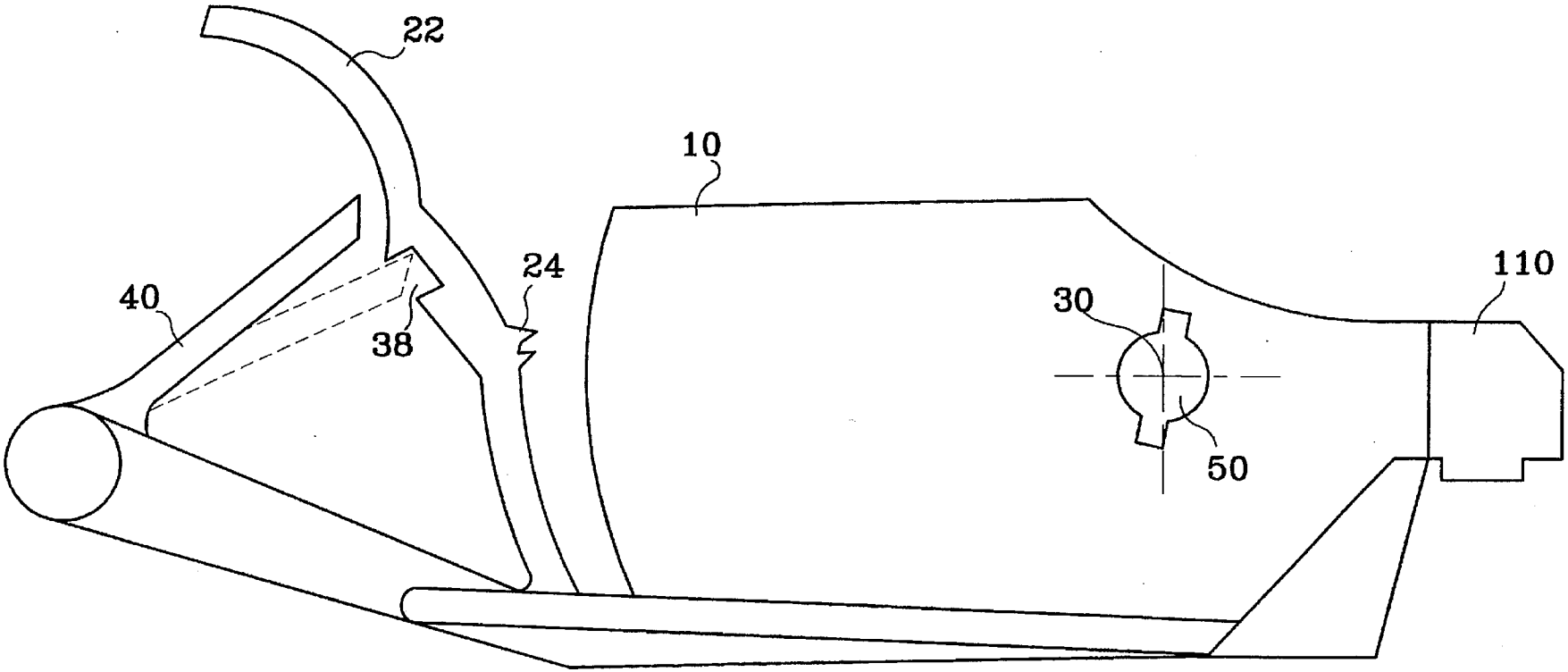
FIG. 3A shows the bracket portion of the present invention without a mounting plate or a switch attached.

FIG. 3A shows the bracket portion 10 of the present invention without the mounting plate 12 or the switch 14. The illustration in FIG. 3A more clearly shows the protrusion 24 which can comprise two pointed members that are shaped to fit into the interstitial spaces of the plurality of teeth 20 described above. The locking arm 40 is shown in its unlocked position by solid lines and in its locked position by dashed lines. The locked position occurs when the locking member 40 is disposed in the notch 38. A hole 50 is provided though a wall of the bracket portion 10 for the purpose of receiving a pivot portion of the mounting plate 12 when the mounting plate is attached to the bracket portion 10.

Figure 3B:
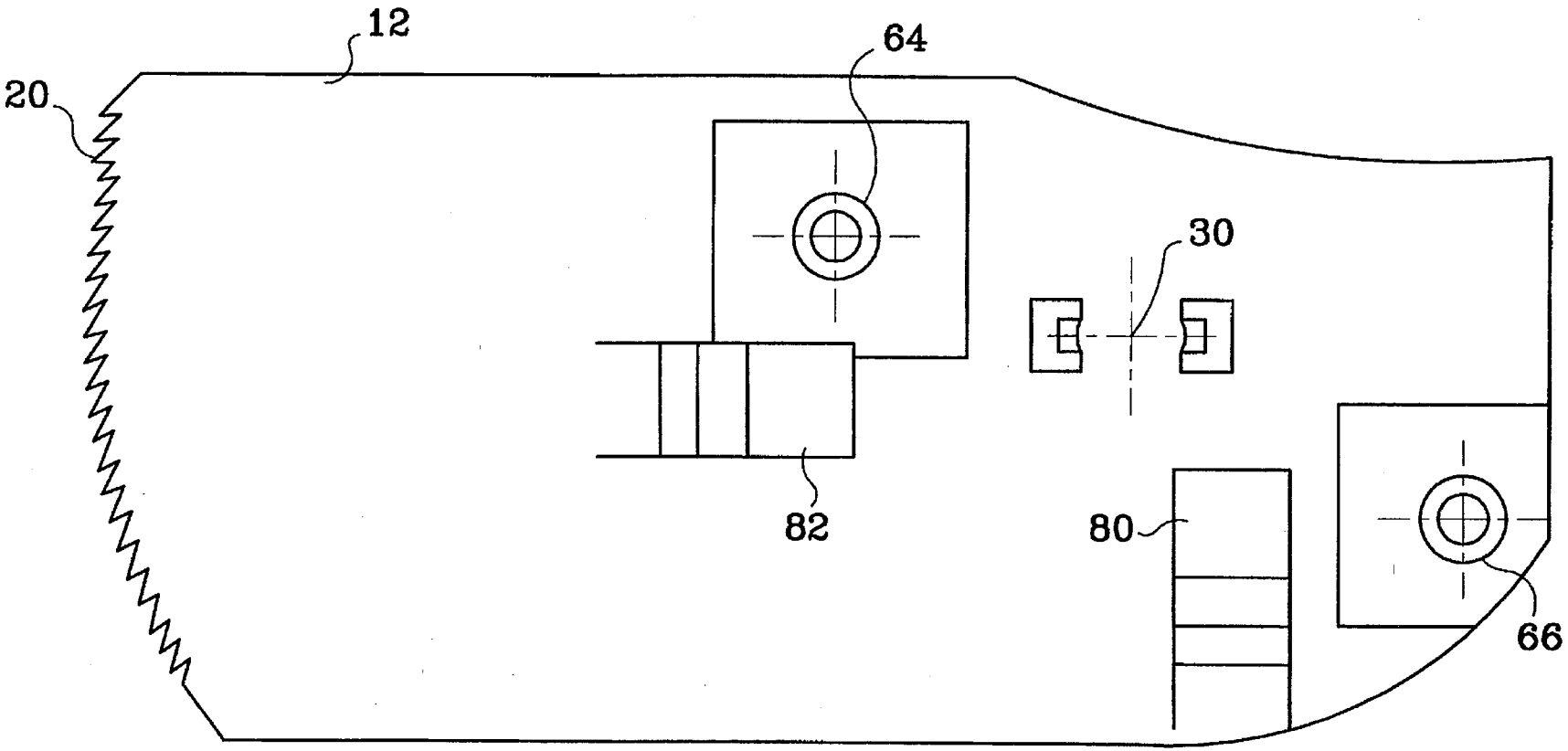
FIG. 3B shows the mounting plate of the present invention without the bracket portion or a switch attached to it.

FIG. 3B shows the mounting plate 12 of the present invention. Also shown in FIG. 3B are the locating pins, 64 and 66, and the fingers, 80 and 82, which will be described in greater detail below in conjunction with FIG. 4. The mounting plate 12 is attachable to the bracket portion 10 by inserting a pivot 60, which will be described below in greater detail in conjunction with FIG. 4, into the hole 50 described above in conjunction with FIG. 3A. This assembly of the mounting plate to the bracket portion allows the rotatable attachment of these two components. This rotatable attachment of the mounting plate to the bracket portion also disposes the plurality of teeth 20 in contact with the protrusion 24.

Figure 4:
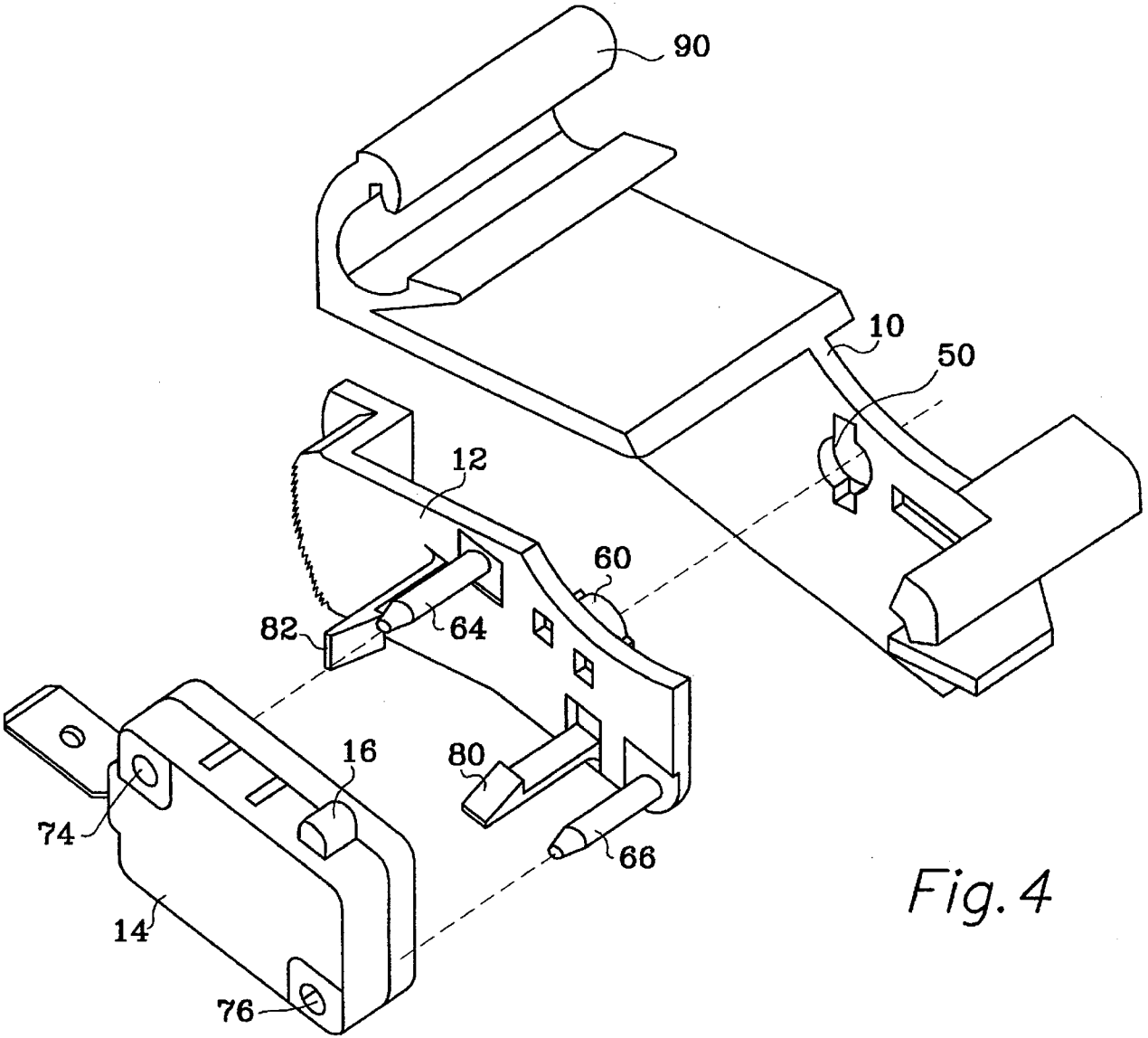
FIG. 4 is an exploded perspective view of one embodiment of the present invention showing the bracket portion, the mounting plate and a switch.

FIG. 4 is an exploded perspective view of the bracket portion 10, the mounting plate 12 and a switch 14. The pivot 60 of the mounting plate 12 is disposable though the hole 50 in order to provide a rotational pivot that allows the mounting plate 12 to rotate relative to the bracket portion 10. Two pins, 64 and 66, are shaped to be received in mounting holes, 74 and 76, of the switch 14. These pins serve to guide the switch 14 into a proper position relative to the mounting plate 12. Two fingers, 80 and 82, are shaped to snap over the edges of the switch 14 and retain the switch in a rigid position relative to the mounting plate 12.

In the embodiment of the present invention illustrated in FIG. 4, the bracket portion 10 is provided with a mounting structure 90 that is specifically shaped to be attachable to a portion of an appliance housing and to allow a slight rotation of the bracket portion 10 relative to the appliance. It should be clearly understood that the particular shape of the mounting structure 90 is determined by the intended portion of the appliance housing on which it is to be attached. It should also be understood that alternative methods of attaching the bracket portion 10 to a stationary object are possible within the scope of the present invention. In FIG. 4, the protrusion 24 is not shown.

Figure 5:
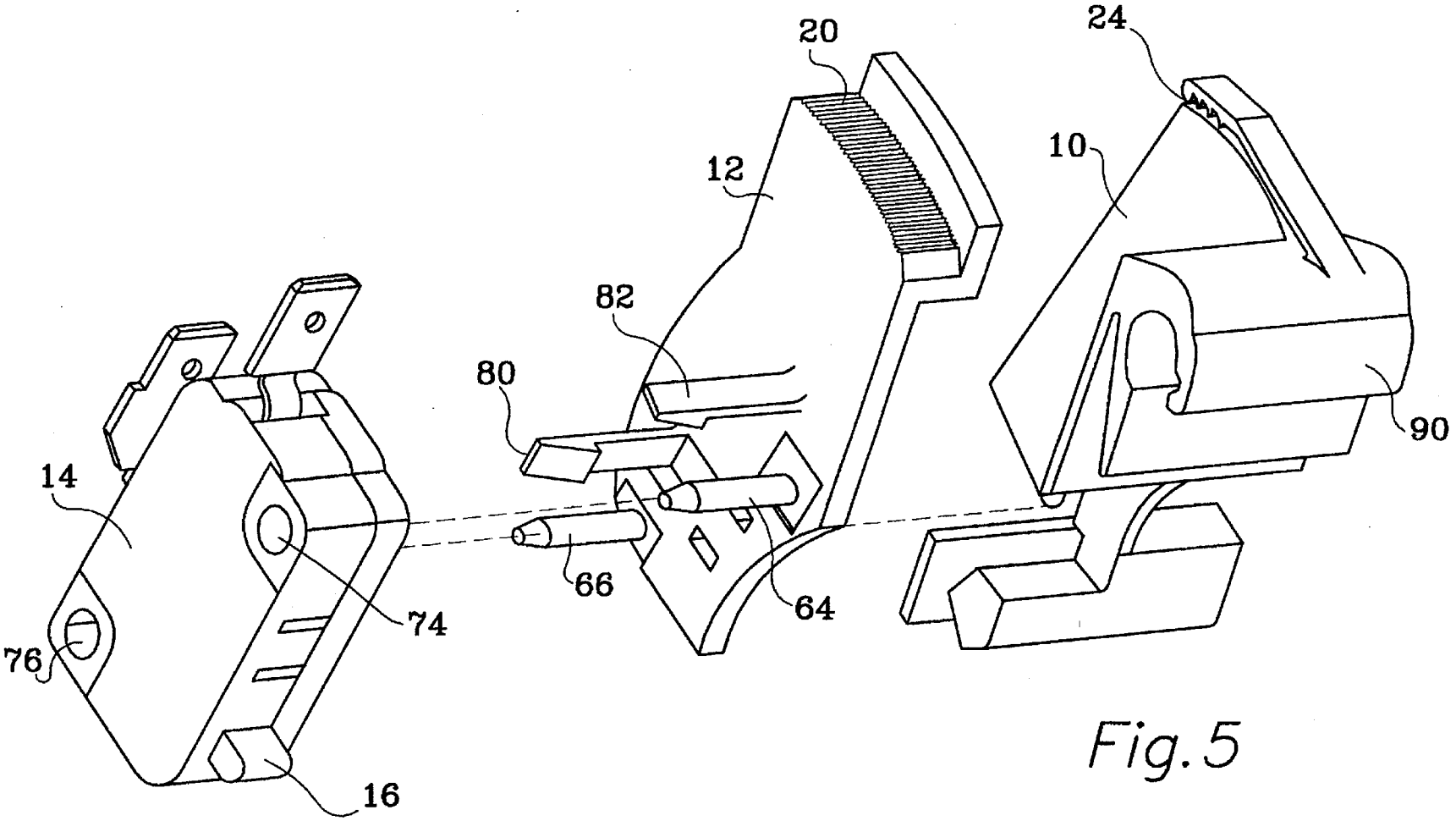
FIG. 5 is an alternative view of the illustration of FIG. 4.

FIG. 5 is an exploded perspective view of the present invention from a different point of view than that of FIG. 4. The view of FIG. 5 shows the plurality of teeth 20 and the protrusion 24 which, in FIG. 5, comprises three sharp points that are shaped to be received in interstitial spaces of the plurality of teeth 20.

Figure 6:
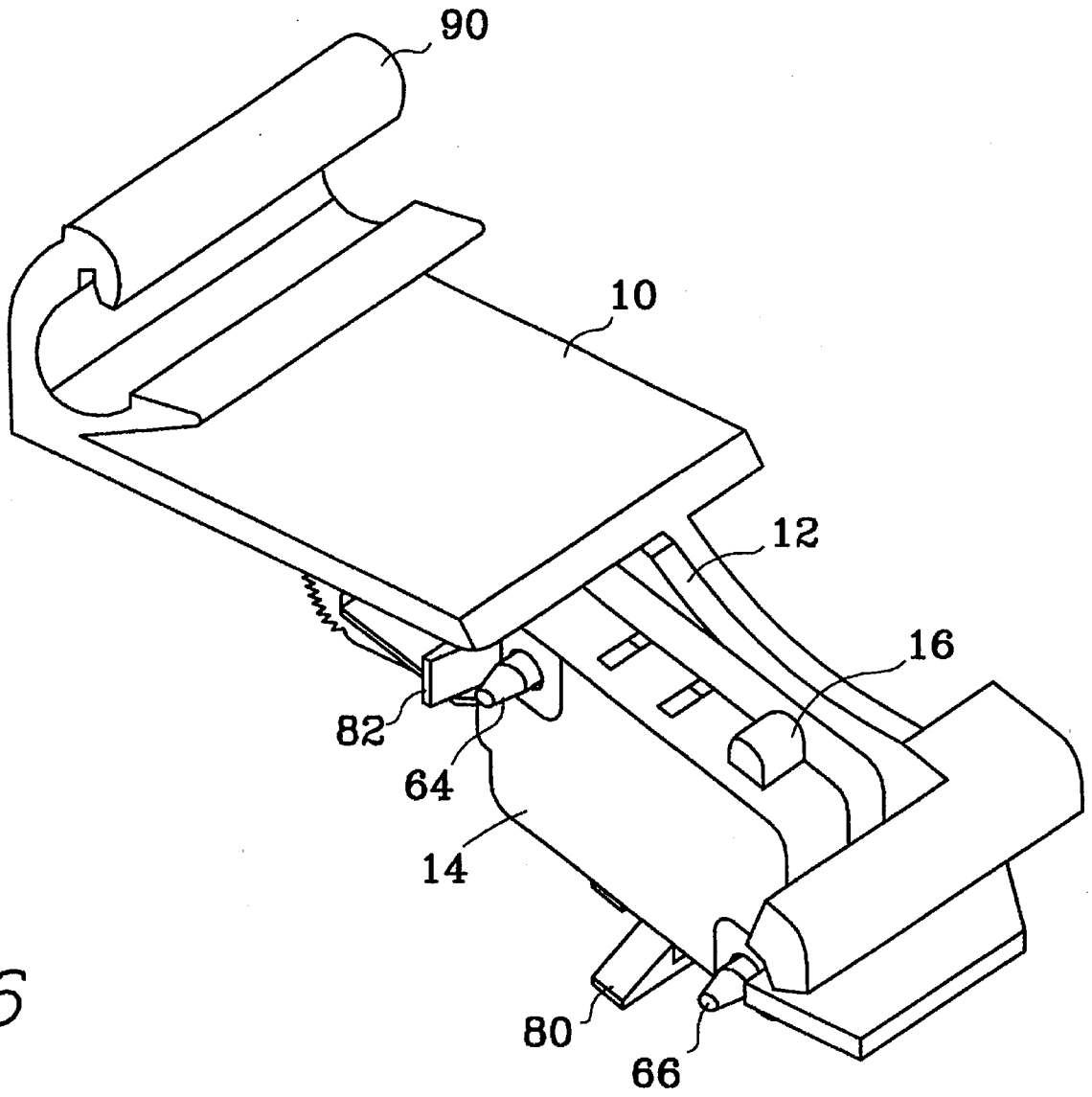
FIG. 6 is a perspective assembled view of the embodiment illustrated in FIGS. 4 and 5.

FIG. 6 is a perspective view of an assembled mechanism made in accordance with the present invention. As can be seen, the embodiment of the present invention illustrated in FIGS. 4, 5 and 6 does not comprise the locking structure described above in conjunction with FIGS. 1, 2 and 3. That locking mechanism, which is provided by the locking member 40 and the notch 38, is not required in all embodiments of the present invention. FIG. 6 shows the switch 14 mounted on the mounting plate 12 which is, in turn, rotatable attached to the bracket portion 10.

Figure 7:
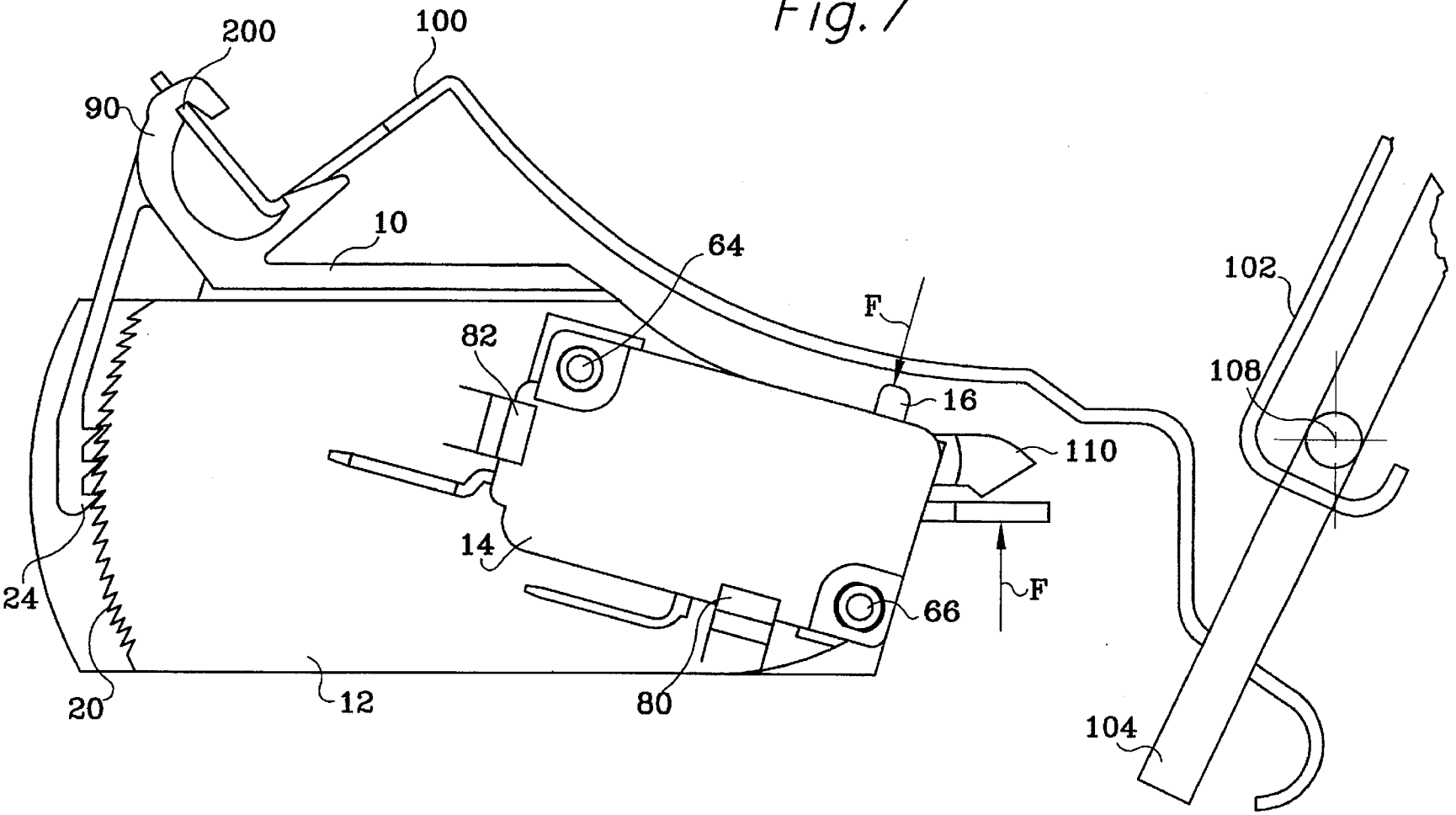
FIG. 7 shows one embodiment of the present invention assembled in conjunction with a stationary portion of an appliance and a movable door of the appliance.

FIG. 7 shows the present invention attached to a stationary portion of an appliance. In the embodiment shown in FIG. 7, the mounting portion 90 of the present invention is snapped in place on a shaped plate 100 which is a part of the housing structure of an appliance. A door 102 is provided with an attached bar 104. The door 102 is rotatable relative to the appliance housing structure about a point 108. FIG. 7 shows the door 102 in an open position. The embodiment of the present invention is similar to the embodiments shown in FIGS. 4, 5 and 6. When the actuating bar 104 rotates in a clockwise direction about point 108, it eventually makes contact with the portion of the mounting plate identified by reference numeral 110. This contact creates a force F against the bracket portion and moves the plunger 16 against the curved portion of the bracket 100 that is a part of the housing structure of the appliance. The opposing force F on the plunger 16 is equal to the force F against component 110 exerted by the actuating bar 104.

With continued reference to FIG. 7, the sequential operation of the present invention will be described as it occurs initially during the assembly of the device in the appliance, the calibration of the device and the subsequent use by a purchaser of the device.

When the door 102 is initially closed after the mechanism is assembled in the appliance, the initial closure of the door first depresses the plunger 16 and then, after the plunger 16 is completely depressed, pushes against the switch to cause the mounting plate 12 to rotate clockwise relative to the bracket portion 10. Following a complete closure of the door 102, the protrusion 24 will be located in the interstitial spaces of teeth 20 that define the maximum travel of the mounting plate relative to the bracket portion 10. When the door 102 is again opened, the mounting plate 12 will remain in that position relative to the bracket portion 10. Subsequent closures of the door 102 will not cause further rotation of the mounting plate 12 relative to the bracket portion 10. Instead, those subsequent closures of the door 102 will only depress the plunger 16 into the housing of the switch 14.

As a result of the rotation of the bracket portion 10 about its point of attachment to a stationary portion of an appliance. Where the mounting portion 90 is attached to the appliance housing structure 100. This point of rotation of the bracket portion 10 is identified by reference number 200 in FIG. 7 and represents the point on the stationary portion of the appliance about which the bracket portion 10 rotates in response to contact between the actuating bar 104 and the component identified by reference numeral 110.

Although FIG. 7 does not illustrate an embodiment of the present invention that comprises a locking mechanism as described above in conjunction with FIGS. 1, 2 and 3, it should be understood that it could comprise a similar locking mechanism. When a locking mechanism is incorporated in the present invention, the locking member 40 would be manually disposed into the notch 38 following the initial closure of the door to set the proper calibration position of the switch 14 in relation to the actuation bar 104 that is attached to the door 102. After insertion of the locking member 40 into the notch 38, subsequent closures of the door will not change the position of the protrusion 24 relative to the plurality of teeth 20 even if the door is slammed shut with a jarring motion.

Figure 8:
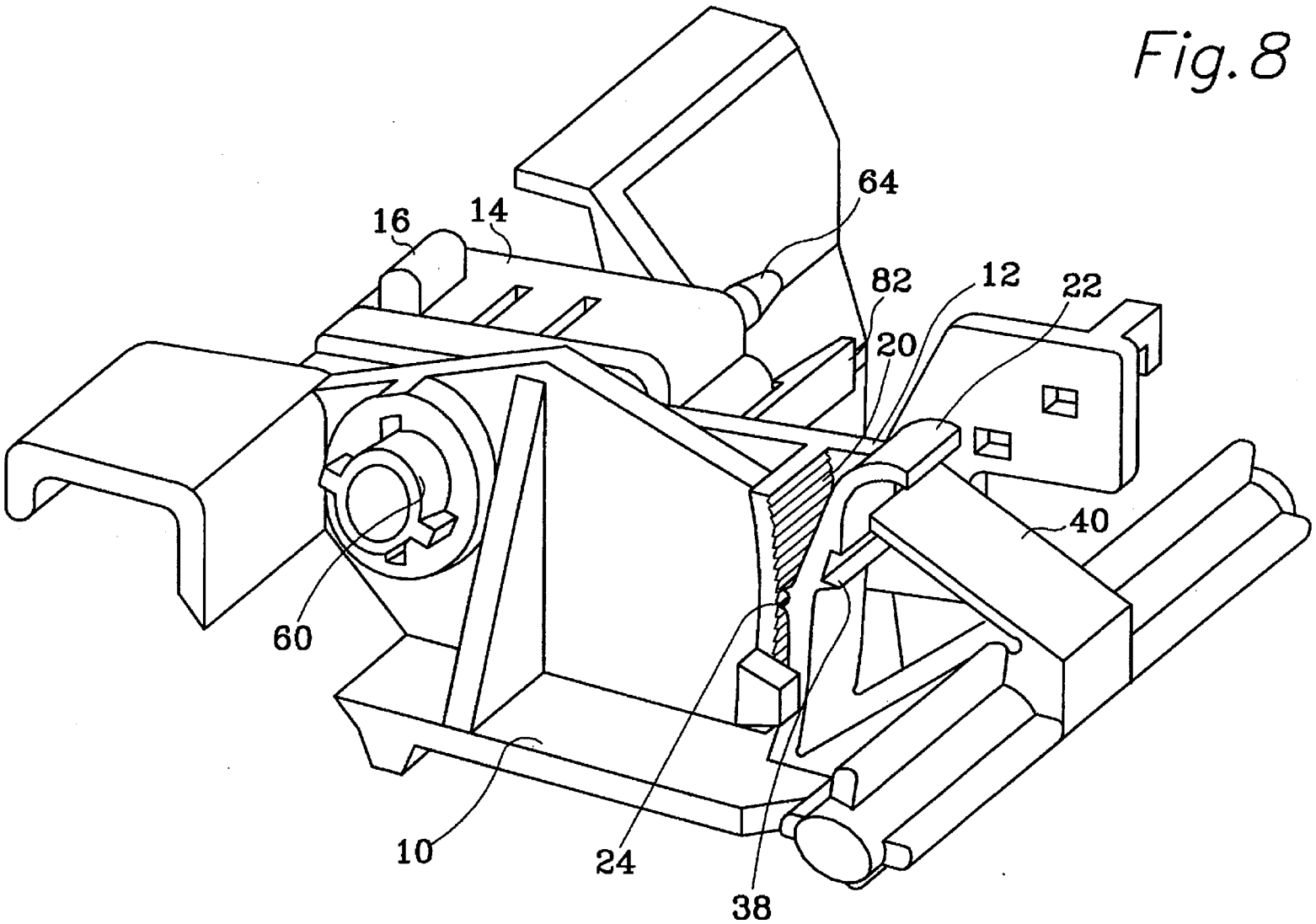
FIG. 8 shows an alternative embodiment of the present invention in perspective view and assembled with a switch 14.

FIG. 8 is a perspective view of an embodiment of the present invention that incorporates a different type of mounting structure. In conjunction with FIG. 7, a mounting portion 90 was used to snap onto the shaped plate 100. In FIG. 8, the mechanism of the present invention is attached to the stationary portion of a washing machine in a different manner which does not require the use of the mounting portion 90. However, it should be understood that the specific means employed to mount the present invention in a washing machine is not limiting to the present invention. Many different techniques can be used to attach the bracket portion 10 of the present invention to the stationary housing of an appliance. In FIG. 8, the plurality of teeth 20 are shown disposed in contact with the teeth of a protrusion 24 that is mounted on the adjustment cantilever 22. The adjustment cantilever 22 is shown provided with a notch 38 into which the locking arm 40 can be disposed to prevent any further movement between the protrusion 24 and the plurality of teeth 20. The switch 14 is shown attached to the mounting plate 12 with one of the locating pins 64 extending through a hole in the switch. In addition, one of the fingers 82 is shown holding the switch 14 in position against the mounting plate 12. The pivot 60, which is an extension of the mounting plate 12, is shown extending through a hole in the bracket portion 10. The hole through which the pivot 60 extends is described above in conjunction with FIG. 4 and identified by reference numeral 50.

By comparing FIGS. 6 and 8, it can be seen that the basic characteristics of the present invention can be employed in a mechanism that can be shaped in various ways to accommodate specific applications. In other words, the mounting portion 90 shown in FIG. 6 can be used to attach the bracket portion 10 to a washing machine, but it is not necessary in all embodiments. Similarly, the locking mechanism, which combines the notch 38 and the locking arm 40, is useful in resisting jarring forces on the mechanism, but is not required in all embodiments of the present invention.

In the description of the present invention described above, several embodiments were illustrated and discussed. Certain embodiments incorporate a locking mechanism that comprises the locking member 40 and the notch 38. The protrusion 24 has been described as having a single pointed structure, two pointed structures or three pointed structures that move into the interstitial spaces of the plurality of teeth 20. Certain embodiments of the present invention can be operated by having an actuator bar 104 move directly in contact with a plunger 16. Other embodiments of the present invention can have an actuator bar move the switch in contact with a bracket 100 that is attached to the stationary housing structure of the appliance. These variations are not limiting to the present invention and do not change its character.

The basic characteristic of the present invention is that it provides a mechanism to hold a switch in an appropriate position. In addition, the present invention permits the mechanism to self adjust upon an initial actuation of the switch 14 by a movable member, such as the door 102 of an appliance. The initial actuation of the device by the door causes the plunger 16 of the switch 14 to be depressed into the switch housing. Following this maximum travel of the plunger 16, further exertion of the force F moves the mounting plate 12 relative to the bracket portion 10 of the mechanism. The retaining means, which comprises the plurality of teeth 20 and the protrusion 24, hold the mounting plate 10 in this proper position after removal of the force F exerted by the door of an appliance. Further actuations of the switch 16 by the door 102 will cause the plunger 16 to be depressed into the housing of the switch, but will not cause further movement of the mounting plate 12 relative to the bracket portion 10 of the mechanism. The initial actuation of the mechanism creates the proper calibration and positions the switch at its appropriate operating location. Certain embodiments of the present invention further provide a means for permanently locking the mounting plate in position relative to the bracket structure in order to prevent misalignment that could be caused by a sudden jarring force against the mechanism.

Although the present invention has been described with particular detail and illustrated with specificity, alternative embodiments of the present invention are also within its scope.

The embodiments of the invention in which an exclusive property or right is claimed are defined as follows:

1. A self adjusting switch mechanism, comprising:

a bracket portion, said bracket portion being shaped to be attachable to an external stationary object;

a mounting plate rotatably attached to said bracket portion, said mounting plate being shaped to receive a switch in a fixed relationship with said mounting plate, said mounting plate being rotatable relative to said bracket portion in response to a force greater than a preselected magnitude exerted against an actuator of said switch; and means for retaining said mounting plate in a fixed position relative to said bracket portion when said external force is less than said preselected magnitude, said retaining means being configured to permit said mounting plate to move relative to said bracket portion when said force exceeds said preselected magnitude.

2. The mechanism of claim 1, wherein:

said force is exerted against said actuator of said switch by a movable member.

3. The mechanism of claim 2, further comprising:

said switch; and said stationary object, said movable member being attached to said stationary object.

4. The mechanism of claim 3, wherein:

said actuator of said switch is movable relative to a housing of said switch in response to said force being less than said preselected magnitude.

5. The mechanism of claim 1, wherein:

said retaining means comprises a plurality of teeth formed in said mounting plate and a protrusion extending from said bracket portion, said protrusion being disposable in contact with one of said plurality of teeth.

6. The mechanism of claim 1, further comprising:

means for locking said retaining means to prevent said mounting plate from moving relative to said bracket portion in response to said force being greater than said preselected magnitude.

7. The mechanism of claim 6, wherein:

said locking means comprises a notch in an adjustment member of said bracket portion and a locking member of said bracket portion, said locking member being disposable into said notch to prevent said mounting plate from moving relative to said bracket portion when said force exceeds said preselected magnitude.

8. The mechanism of claim 3, wherein:

said stationary object is a housing of an appliance and said force is exerted by a door of said appliance.

9. A self adjusting switch mechanism, comprising:

a stationary object;

a bracket portion, said bracket portion being shaped to be attachable to said stationary object;

a mounting plate rotatably attached to said bracket portion, said mounting plate being shaped to receive a switch in a fixed relationship with said mounting plate, said mounting plate being rotatable relative to said bracket portion in response to a force greater than a preselected magnitude exerted against an actuator of said switch;

means for retaining said mounting plate in a fixed position relative to said bracket portion when said external force is less than said preselected magnitude, said retaining means being configured to permit said mounting plate to move relative to said bracket portion when said force exceeds said preselected magnitude; and a movable member attached to said stationary object, said force being exerted against said actuator of said switch by said movable member.

10. The mechanism of claim 9, further comprising:

said switch.

11. The mechanism of claim 10, wherein:

said actuator of said switch is movable relative to a housing of said switch in response to said force being less than said preselected magnitude.

12. The mechanism of claim 9, wherein:

said retaining means comprises a plurality of teeth formed in said mounting plate and a protrusion extending from said bracket portion, said protrusion being disposable in contact with one of said plurality of teeth.

13. The mechanism of claim 9, further comprising:

means for locking said retaining means to prevent said mounting plate from moving relative to said bracket portion in response to said force being greater than said preselected magnitude.

14. The mechanism of claim 13, wherein:

said locking means comprises a notch in an adjustment member of said bracket portion and a locking member of said bracket portion, said locking member being disposable into said notch to prevent said mounting plate from moving relative to said bracket portion when said force exceeds said preselected magnitude.

15. The mechanism of claim 9, wherein:

said stationary object is a housing of an appliance and said force is exerted by a door of said appliance.

16. A self adjusting switch mechanism, comprising:

a stationary object;

a bracket portion, said bracket portion being attachable to said stationary object;

a mounting plate rotatably attached to said bracket portion, said mounting plate being shaped to receive a switch in a fixed relationship with said mounting plate, said mounting plate being rotatable relative to said bracket portion in response to a force greater than a preselected magnitude exerted against an actuator of said switch;

means for retaining said mounting plate in a fixed position relative to said bracket portion when said external force is less than said preselected magnitude, said retaining means being configured to permit said mounting plate to move relative to said bracket portion when said force exceeds said preselected magnitude; and a movable member attached to said stationary object, said force being exerted against said actuator of said switch by said movable member, said actuator of said switch being movable relative to a housing of said switch in response to said force being less than said preselected magnitude.

17. The mechanism of claim 16, further comprising:

said switch.

18. The mechanism of claim 16, wherein:

said retaining means comprises a plurality of teeth formed in said mounting plate and a protrusion extending from said bracket portion, said protrusion being disposable in contact with one of said plurality of teeth.

19. The mechanism of claim 16, further comprising:

means for locking said retaining means to prevent said mounting plate from moving relative to said bracket portion in response to said force being greater than said preselected magnitude.

20. The mechanism of claim 19, wherein:

said locking means comprises a notch in an adjustment member of said bracket portion and a locking member of said bracket portion, said locking member being disposable into said notch to prevent said mounting plate from moving relative to said bracket portion when said force exceeds said preselected magnitude, said stationary object being a housing of an appliance and said force being exerted by a door of said appliance.

* * * * *